US011976529B2

(12) United States Patent
Sneed et al.

(10) Patent No.: US 11,976,529 B2
(45) Date of Patent: May 7, 2024

(54) INTERCHANGEABLE PACKOFF ASSEMBLY FOR WELLHEADS

(71) Applicant: INNOVEX DOWNHOLE SOLUTIONS, INC., Houston, TX (US)

(72) Inventors: Brian Sneed, Houston, TX (US); Moyo Terebo, Houston, TX (US); Mark McGilvray, Jr., Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 17/860,210

(22) Filed: Jul. 8, 2022

(65) Prior Publication Data

US 2023/0008109 A1 Jan. 12, 2023

Related U.S. Application Data

(60) Provisional application No. 63/219,871, filed on Jul. 9, 2021.

(51) Int. Cl.
*E21B 33/04* (2006.01)

(52) U.S. Cl.
CPC ..... *E21B 33/0422* (2013.01)

(58) Field of Classification Search
CPC .... E21B 33/0422; E21B 33/04; E21B 33/047; E21B 33/043
See application file for complete search history.

(56) References Cited

U.S. PATENT DOCUMENTS 3,679,238 A * 7/1972 Putch ..... E21B 33/0422 285/347
4,759,409 A * 7/1988 Gullion ..... E21B 33/043 166/182
4,900,041 A * 2/1990 Hopkins ..... E21B 33/04 166/115
5,031,695 A * 7/1991 Cain ..... E21B 33/0422 166/208
5,342,066 A * 8/1994 Henley ..... F16J 15/128 166/208
6,488,084 B1 * 12/2002 Borak, Jr. ..... E21B 33/0422 166/208
9,534,465 B2 * 1/2017 Nguyen ..... E21B 33/03
(Continued)

FOREIGN PATENT DOCUMENTS

WO 2020139944 A1 7/2020

OTHER PUBLICATIONS

Tae Wook Park (Authorized Officer), International Search Report and Written Opinion dated Oct. 27, 2022, PCT Application No. PCT/US2022/036442, 12 pages.

*Primary Examiner* — Kipp C Wallace
(74) *Attorney, Agent, or Firm* — MH2 TECHNOLOGY LAW GROUP, LLP

(57) ABSTRACT

A packoff for a wellhead includes a body configured to be positioned in an annulus between the wellhead and an inner tubular above a casing hanger supported in the wellhead, the body including a bore and a lower end, the bore and the lower end being configured to be positioned at least partially around the inner tubular. The lower end is configured to be spaced apart from the casing hanger. The packoff also includes a first load shoulder member configured to be removably connected to the lower end of the body and to engage a surface of the casing hanger so as to form a seal therewith.

13 Claims, 8 Drawing Sheets

(56) References Cited

U.S. PATENT DOCUMENTS

| | | | | |
|---|---|---|---|---|
| 2010/0288483 | A1 | 11/2010 | Cain et al. | |
| 2014/0345850 | A1 | 11/2014 | Galle et al. | |
| 2019/0093439 | A1 | 3/2019 | Kauffmann et al. | |
| 2020/0048978 | A1* | 2/2020 | Chirko | E21B 33/04 |
| 2022/0065100 | A1* | 3/2022 | Lim | G01S 15/08 |

* cited by examiner

INTERCHANGEABLE PACKOFF ASSEMBLY FOR WELLHEADS

CROSS-REFERENCE TO RELATED APPLICATIONS

This application claims benefit of U.S. Provisional Application No. 63/219,871, which was filed on Jul. 9, 2021 and is incorporated herein by reference in its entirety.

BACKGROUND

Oil and gas wells often have a wellhead positioned at the top of the well. During drilling operations, a blowout preventer (BOP) can be positioned on the top of the wellhead, and later, to produce fluid from the well, a production head can be positioned on the wellhead. The wellhead may be configured to contain pressure in the well below. Generally, casing is suspended within the wellhead from a casing hanger. The casing hanger may be secured to the casing (e.g., threaded to the top of the casing), and then lowered through the wellhead until the casing hanger lands on a landing shoulder formed in the wellhead.

After cementing, a packoff is positioned between the casing and the wellhead housing. This packoff locates between machined surfaces on the wellhead housing and the casing hanger and serves to provide an annular pressure seal between the casing and the wellhead (or between two concentric casings within the wellhead).

Occasionally, the casing with the casing hanger secured to the top, will not smoothly proceed to full deployment (e.g., to the bottom of the well). The casing may also not be able to be withdrawn upward through the wellhead. In other words, the casing may become stuck. In such a partially-deployed position, the casing hanger may not be properly positioned to land in the wellhead housing. Thus, the casing may be cut above the landing shoulder and a "contingency" or "emergency" casing hanger may be positioned around the casing to take the place of the normal casing hanger. The contingency hanger may include slips, permitting the contingency hanger to slide down over the casing and into position in engagement with the landing shoulder of the wellhead. Axial downward load on the casing may set the slips, thereby supporting the casing.

The different geometries of the "regular" casing hanger and the contingency slips casing hanger generally call for different packoff assemblies, and thus additional, potentially redundant inventories of packoffs to be on hand.

SUMMARY

Embodiments of the disclosure include a packoff for a wellhead. The packoff includes a body configured to be positioned in an annulus between the wellhead and an inner tubular above a casing hanger supported in the wellhead, the body including a bore and a lower end, the bore and the lower end being configured to be positioned at least partially around the inner tubular. The lower end is configured to be spaced apart from the casing hanger. The packoff also includes a first load shoulder member configured to be removably connected to the lower end of the body and to engage a surface of the casing hanger so as to form a seal therewith.

Embodiments of the disclosure also include a kit for a packoff for a wellhead. The kit includes a cylindrical body configured to be positioned in the wellhead, the cylindrical body defining a bore therethrough, and comprising a lower end, and at least one load shoulder member configured to be removably connected to the lower end of the cylindrical body and to engage and seal with a casing hanger that is connected to a tubular and is positioned in the wellhead.

Embodiments of the disclosure further include a method for supporting a casing in a wellhead. The method includes connecting a first casing hanger to a tubular, the first casing hanger having a shoulder configured to engage a landing shoulder of a wellhead, lowering the tubular into a well through the wellhead, connecting a first load shoulder member to a lower end of a cylindrical body of a packoff, determining that the tubular is stuck before the shoulder of the first casing hanger has landed on the landing shoulder, and in response to determining that the tubular is stuck: removing the first casing hanger from the tubular, sliding a contingency slip hanger around the tubular, a bowl of the contingency slip hanger being located against the landing shoulder of the wellhead, and slips of the contingency slip hanger engaging the tubular and extend axially upward from the bowl, disconnecting the first load shoulder member from the cylindrical body of the packoff, connecting a second load shoulder member to the cylindrical body, receiving the packoff, including the second load shoulder member, around the tubular, and lowering the packoff, including the second load shoulder member, along the tubular until a lower end of the second load shoulder member engages a bowl of the contingency slip hanger.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
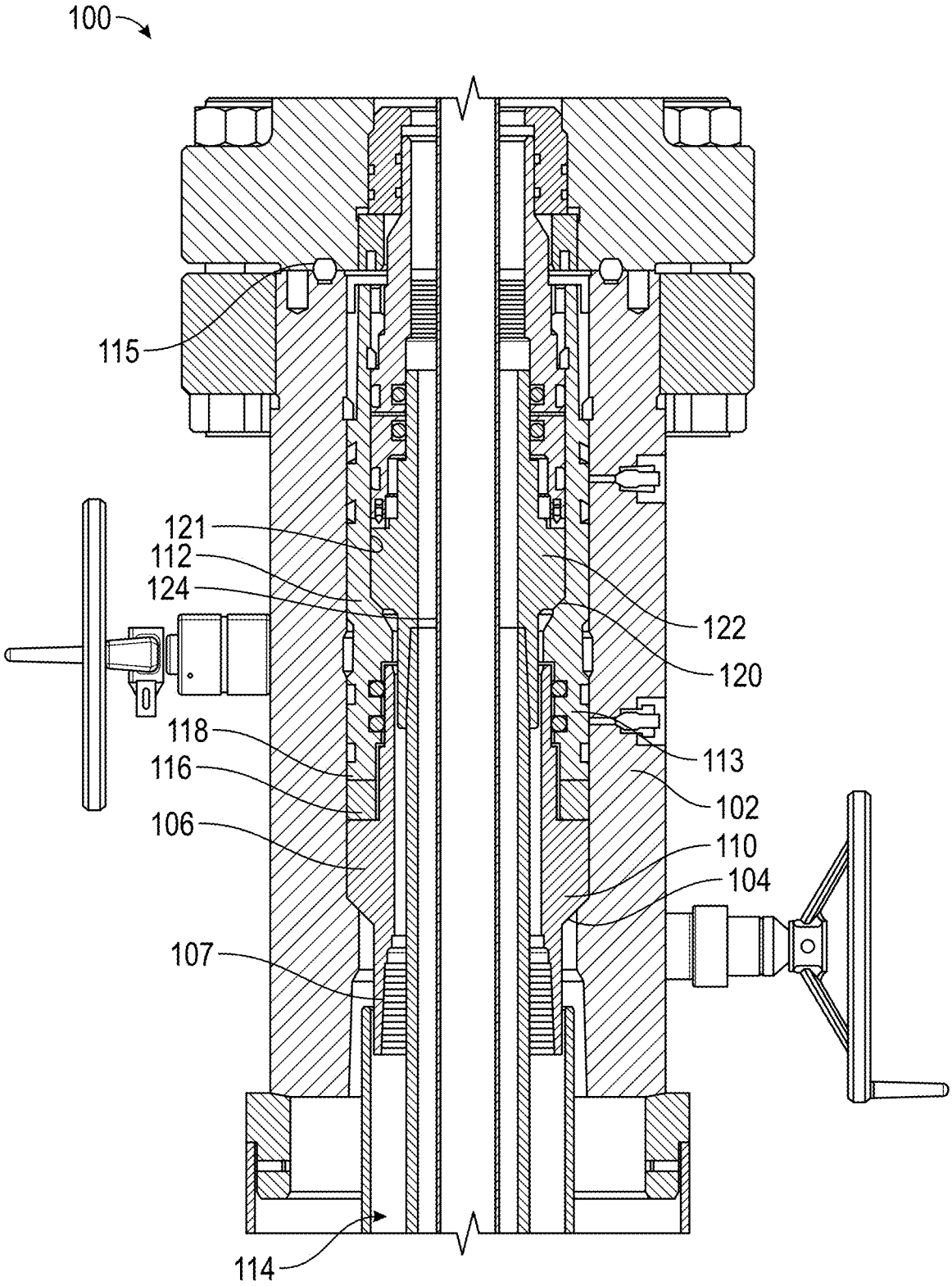
FIG. 1 illustrates a side, cross-sectional view of a wellhead assembly in a first configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a wellhead assembly 100 in a first configuration, according to an embodiment. The wellhead assembly 100 generally includes a wellhead 102, which may define a cylindrical bore therethrough. A landing shoulder 104 may extend into the bore, forming a locating or landing surface for a first or "lower" casing hanger 106. Although referred to herein as "casing hangers", it will be appreciated that such devices may be employed with other types of tubulars. The first casing hanger 106 may be secured to a tubular (not shown) such as casing, via a lower threaded connection 107. The casing or other tubular extends into the well, and the weight of the tubular may be transmitted to the wellhead 102 via a shoulder 110 formed on the first casing hanger 106, which is configured to engage the landing shoulder 104 of the wellhead 102.

A packoff 112 may be positioned at least partially radially between the first casing hanger 106 and the wellhead 102. The packoff 112 may be configured to prevent pressure communication between a well annulus 114 below the wellhead 102 and the upper end 115 of the wellhead 102.

The packoff 112 may include a first load shoulder member 116, which may be coupled to a lower end 118 of a main body 113 of the packoff 112 and may be configured to engage and seal with the casing hanger 106. For example, the shoulder 110 may have a flat upwardly-facing axial surface, and the first load shoulder member 116 may have a flat, downwardly-facing axial surface. The two surfaces may be pressed together, thereby forming a seal (e.g., a metal-metal seal), which may block fluid communication through an annulus defined generally between the inner tubular 108 and the wellhead 102, e.g., between the casing hanger 106 and the wellhead 102.

The packoff 112 may also define an inner bore 121 axially through the main body 113 and the first load shoulder member 116. A landing shoulder 120 may extend into the inner bore, and a second or "upper" casing hanger 122 may be located on the landing shoulder 120. The second casing hanger 122 may be secured to an inner tubular 124 that is smaller in diameter than the tubular to which the casing hanger 112 is connected (not visible in FIG. 1). The inner tubular 124 may thus extend at least partially through the tubular and down into the well below the wellhead 102. The weight of the inner tubular 124 may be transmitted to the wellhead 102 via engagement between the landing shoulder 120 and the second casing hanger 122, and between the packoff 112 and the shoulder 110 of the first casing hanger 106.

As mentioned above, in some situations, the tubular (e.g., casing) to which the first casing hanger 106 is attached may not be deployed entirely into the well but may become stuck in the well. In such case, the first casing hanger 106 may not reach the landing shoulder 104 during run-in of the tubular. When this occurs, the tubular may be cut at a position above the landing shoulder 104. The first casing hanger 106, attached to the cut-off portion, may thus be removed from the tubular and replaced with a contingency slip hanger. Accordingly, the wellhead assembly 100 may not reach the configuration illustrated in FIG. 1, which may represent a successful, full deployment of the tubular and first casing hanger 106.

Figure 2:
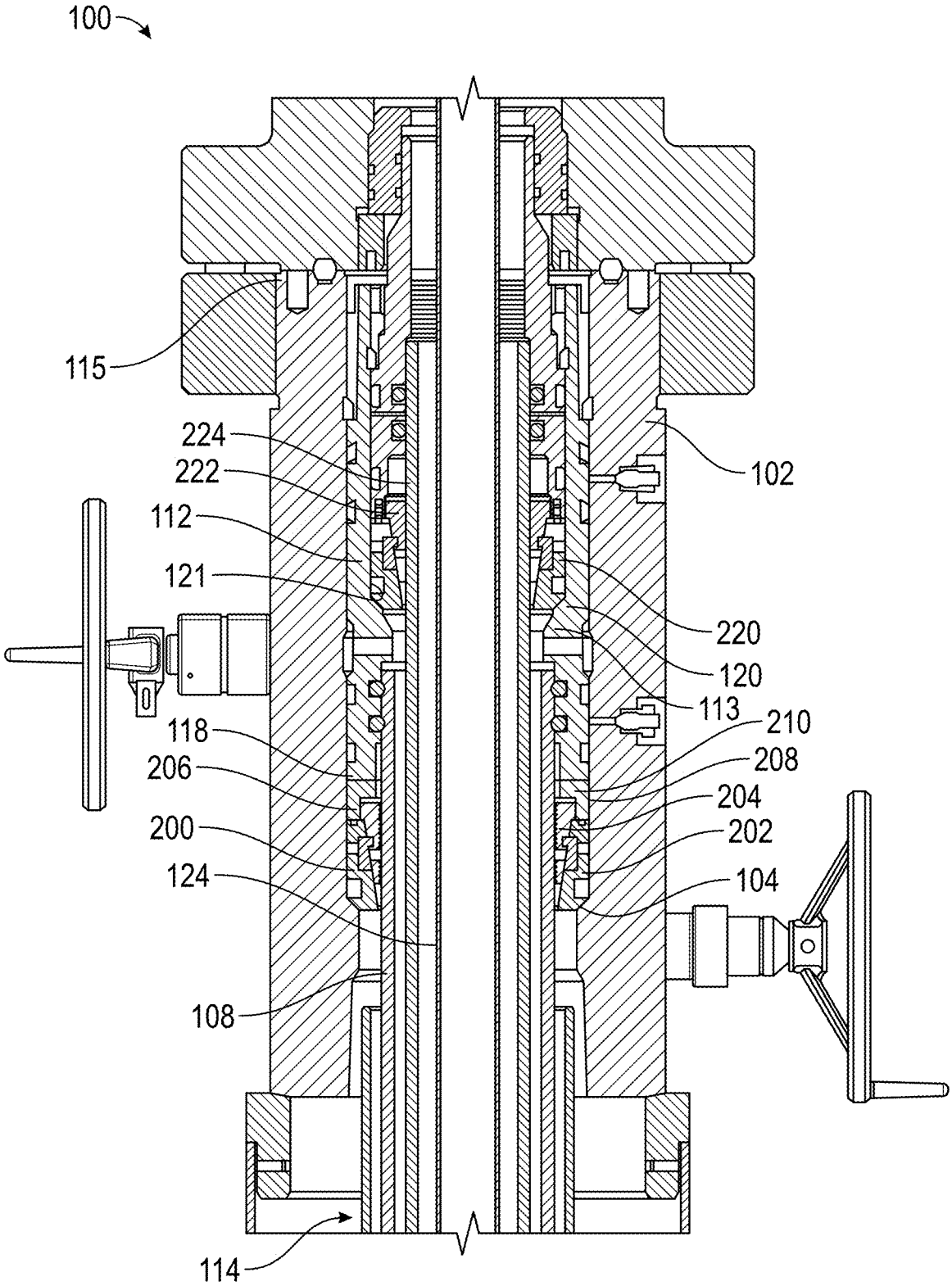
FIG. 2 illustrates a side, cross-sectional view of the wellhead assembly in a second configuration, according to an embodiment.

Referring now to FIG. 2, there is shown the wellhead assembly 100 in a second configuration, according to an embodiment. As shown, the wellhead assembly 100 includes the wellhead 102 with the landing shoulder 104, and a tubular 108 (e.g., casing, to which the first casing hanger 106 was connected) extending therethrough. In this embodiment, however, the tubular 108 has not been fully deployed. Accordingly, the first casing hanger 106 has been removed, and a contingency slip hanger 200 has been received around the tubular 108 and located against the landing shoulder 104. The contingency slip hanger 200 includes a "bowl" 202 (e.g., an annular member with a "tapered" (frustoconical) inner surface) and a plurality of slips 204. The slips 204 may include wickers, teeth, grit, high-friction materials, etc., so as to grip the outer diameter of the tubular 108 and thereby supporting its weight. The slips 204 may be movable axially along the taper of the bowl 202, e.g., such that moving the slips 204 in a downward direction causes the slips 204 to move radially inward, toward one another and thereby engage the tubular 108.

The packoff 112 may again be positioned around the tubular 108, forming a pressure barrier at the top of the well annulus 114. However, the flat, first load shoulder member 116 (FIG. 1) is omitted, because it is not shaped to engage the contingency slip hanger 200, as the slips 204 may extend upward from the bowl 202. Accordingly, a second load shoulder member 206 is connected to the main body 113 of the packoff 112 prior to deployment of the packoff 112 into the wellhead 102. The second load shoulder member 206 may include an annular body 208 and a shoulder 210. The annular body 208 may extend farther axially downward than the shoulder 210, forming a stepped profile for the inner diameter surface of the second load shoulder member 206. Thus, the second load shoulder member 206 may fit over the slips 204, with the lower axial end surface of the annular body 208 engaging the bowl 202 and forming a metal-metal seal therewith, while the shoulder 210 accommodates the slips 204. In some embodiments, as shown, the shoulder 210 may be spaced apart from the slips 204, but in other embodiments, may contact the slips 204.

As with FIG. 1, the packoff 112 may define a landing shoulder 120 therein. The landing shoulder 120 may engage the upper casing hanger 122 as shown in FIG. 1 and discussed above; however, in some situations, the inner tubular 124 may also not be fully deployed into the well. Thus, a second, "upper" contingency slip hanger 220 may be slid into position around the tubular 124 and against the landing shoulder 120. Like the lower contingency slip hanger 200, the upper contingency slip hanger 220 may include slips 222 that are configured to engage the outer diameter surface of a tubular, in this case, tubular 224.

Figure 3A:
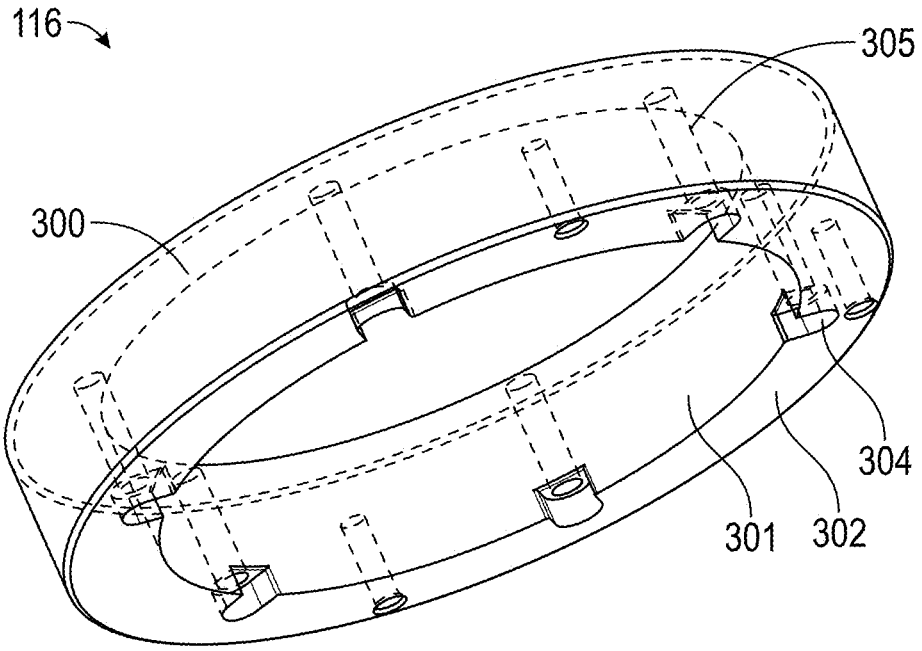
FIG. 3A illustrates a perspective view of a first load shoulder member for a packoff, according to an embodiment

FIG. 3A illustrates a perspective view of the first load shoulder member 116, according to an embodiment. The first load shoulder member 116 includes an annular body 300 having an inner diameter surface 301 and a lower axial end surface 302. As mentioned above, the lower axial end surface 302 may be configured to contact the flat shoulder 110 of the first casing hanger 106. A plurality of pockets 304 may be formed in the annular body 300, extending radially from the inner diameter surface 301 and axially from the lower axial end surface 302. Holes 305 may extend from the pockets 304 axially through the annular body 300. The holes 305 may be configured to receive bolts therethrough, and the pockets 304 may provide an area for the heads of the bolts to be received, without interfering with the engagement between the lower axial end surface 302 and the shoulder 110. The holes 305 and pockets 304 may be formed in a pattern, which refers to the relative location of the holes 305 around the annular body 300. The pattern may match a hole pattern on the lower end 118 of the packoff 112, such that bolts may be received through the holes 305 and threaded into the holes in the lower end 118 of the packoff 112 so as to removably secure the first load shoulder member 116 to the packoff 112.

Figure 3B:
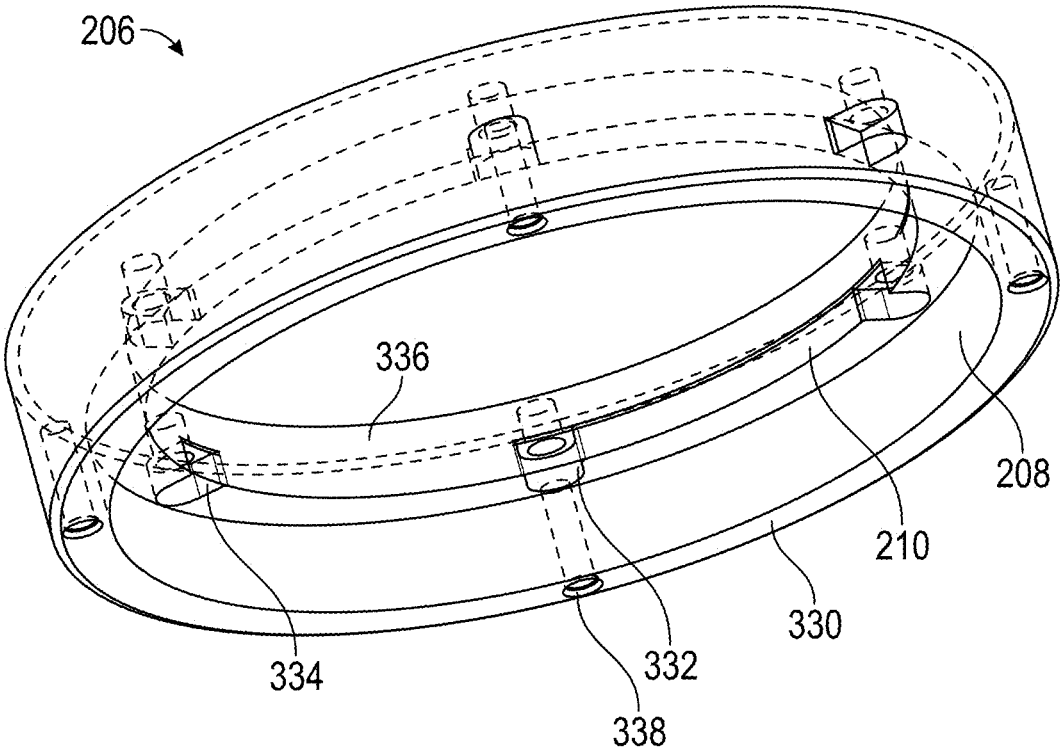
FIG. 3B illustrates a perspective view of a second load shoulder member for the packoff, according to an embodiment.

FIG. 3B illustrates a perspective view of the second load shoulder member 206, according to an embodiment. The second load shoulder member 206 may include the annular body 208 and shoulder 210. As shown, the annular body 208 and the shoulder 210 may be integrally formed from a single piece. The shoulder 210 may extend inward from the annular body 208, and the annular body 208 may extend axially past the shoulder 210 to define a lower axial end surface 330. As such, the profile of the second load shoulder member 206 may be stepped.

Further, the shoulder 210 may define first holes 332 therethrough. Pockets 334 may also be formed in the annular shoulder 210, extending from an inner diameter surface 336 of the shoulder 210 and axially into the shoulder 210. As with the pockets 304, the pockets 334 may be configured to accommodate bolt heads. The annular body 208 may define second holes 338 that extend therethrough, and which may be provided for connection with an anti-rotation feature. The first holes 332 may form a pattern that matches the pattern of the first load shoulder member 116 and the packoff 112. Accordingly, the second load shoulder member 206 may be removably secured to the lower end of the packoff 112 via bolts extending through at least some of the first holes 332.

The first and/or second load shoulder members 116, 206 may be made of any suitable material, e.g., steel, and may be made of the same of different material as the packoff 112. In at least some embodiments, the first and/or second load shoulder members 116, 206 may be a steel alloy, but embodiments in which the first and/or second load shoulder members 116, 206 are composite, lead, aluminum, brass, or any other material are contemplated herein.

Although the first and second load shoulder members 116, 206 are generally shown and described as being annular, it is noted that the first and/or second load shoulder members 116, 206 may be split rings, segmented, or otherwise formed as two or more pieces that connect together and/or individually connect to the packoff 112. That is, the first and/or second load shoulder members 116, 206 may not be continuous rings, but could be made of several arcuate (or any other shape) structures.

Figure 4:
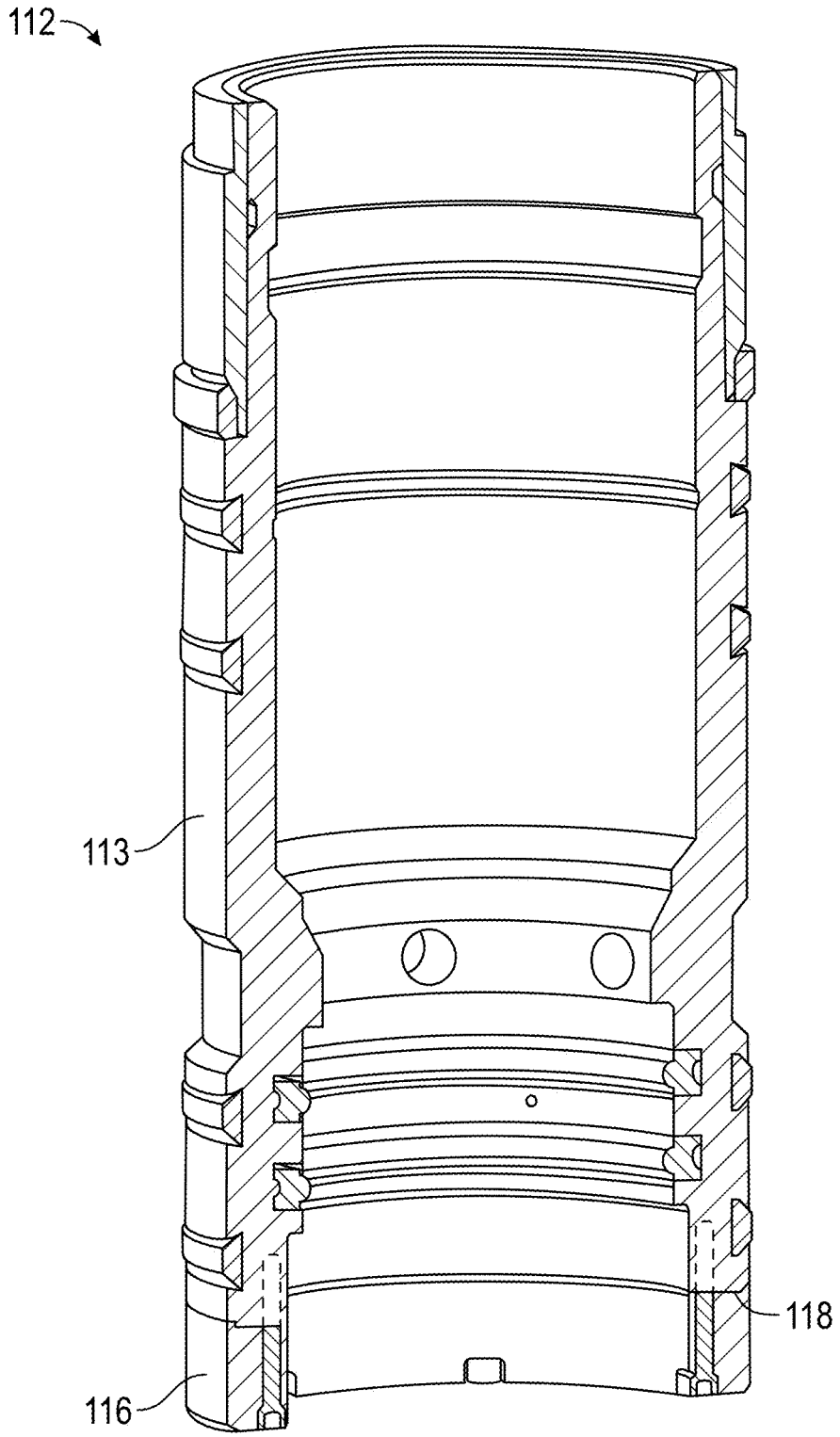
FIG. 4 illustrates a perspective sectional view of the packoff having the first load shoulder member, according to an embodiment.
Figure 5:
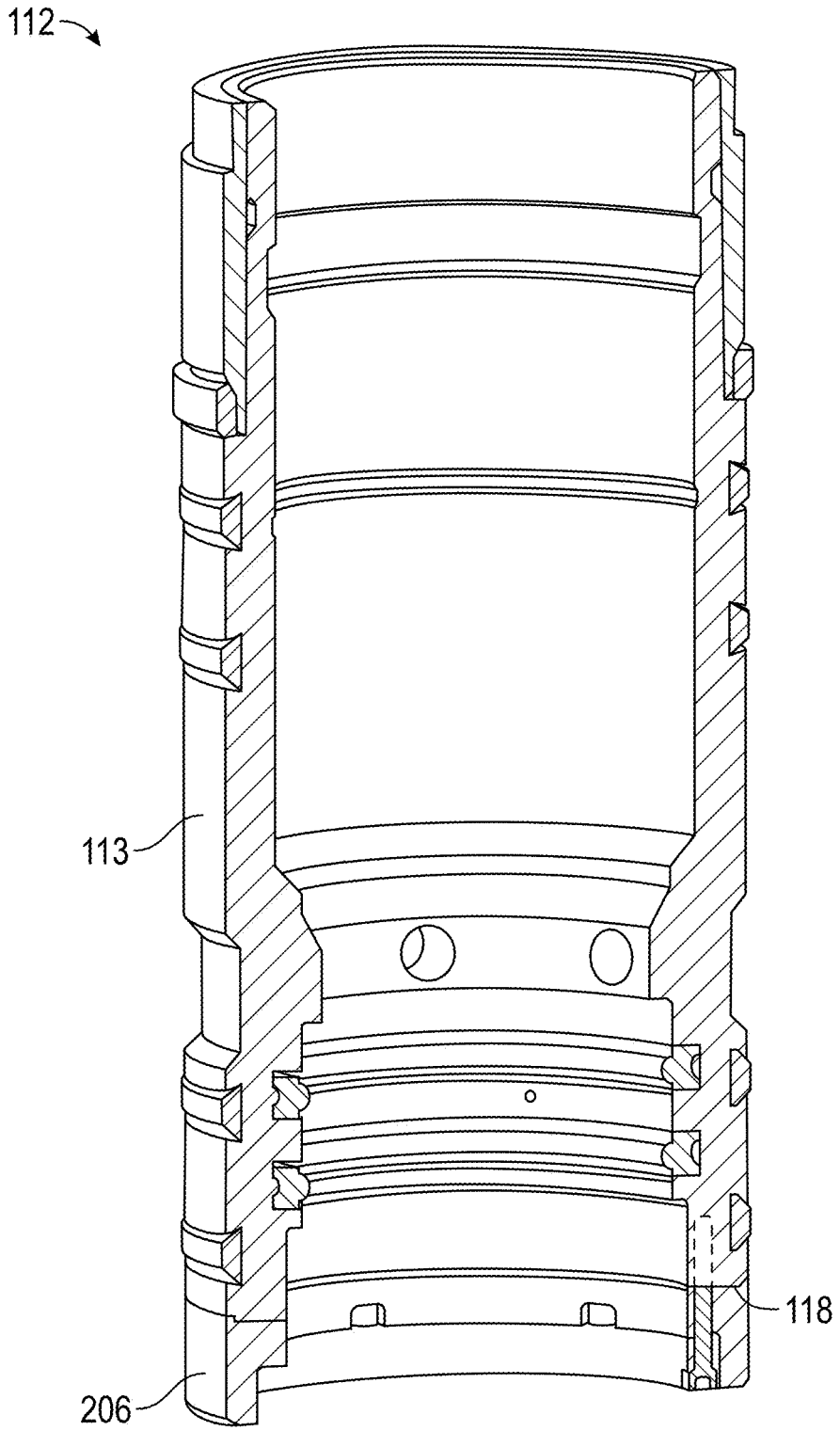
FIG. 5 illustrates a perspective sectional view of the packoff having the second load shoulder member, according to an embodiment.
Figure 6:
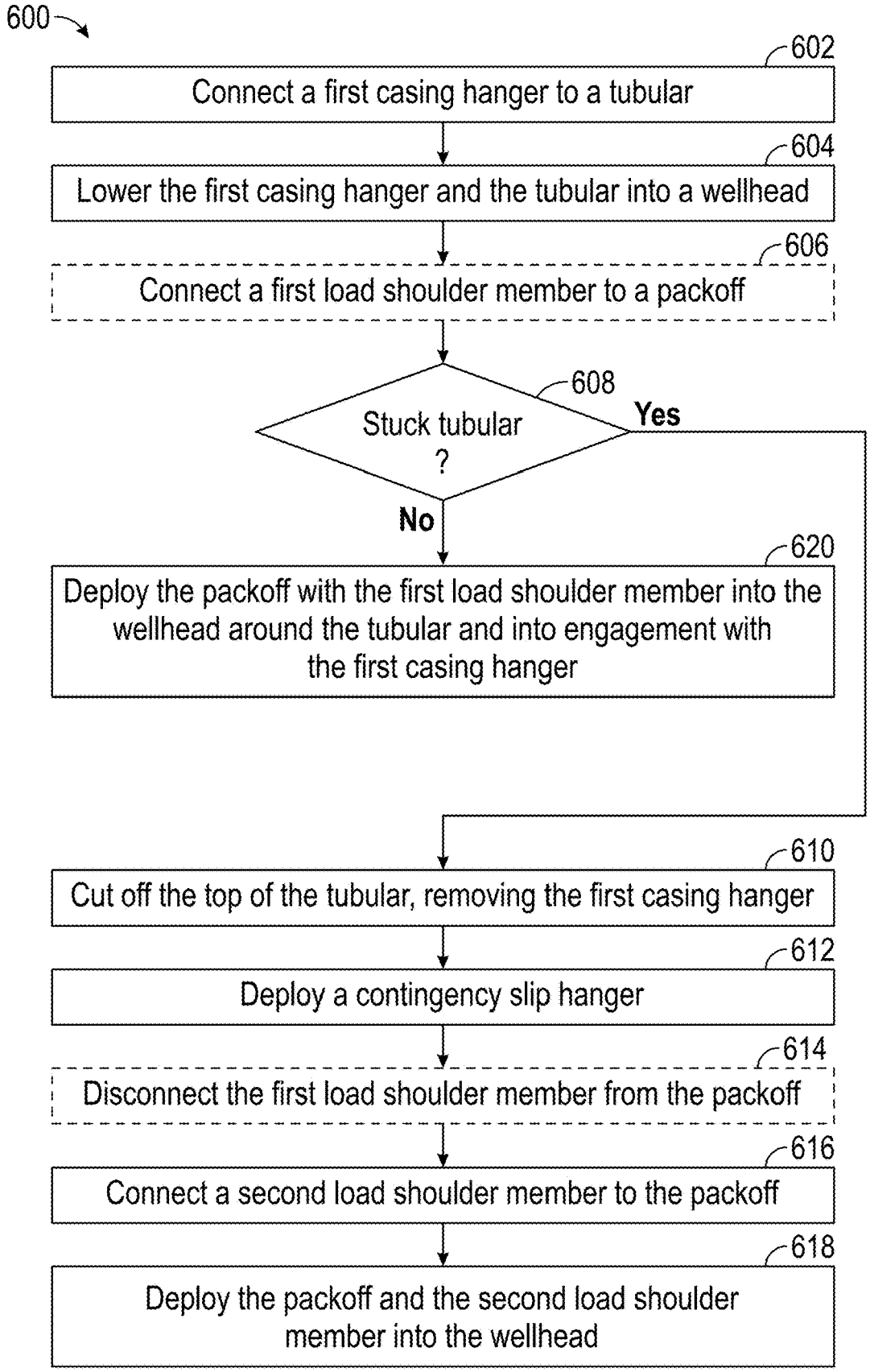
FIG. 6 illustrates a flowchart of a method for supporting a tubular in a wellhead, according to an embodiment.

The first and second load shoulder members 116, 206 may be interchangeably connected to the packoff 112. FIG. 4 illustrates a perspective sectional view of the packoff 112 with the main body 113 defining the lower end 118 to which the first load shoulder member 116 is connected. FIG. 5 illustrates a perspective sectional view of the packoff 112 with the second load shoulder member 206 connected to the lower end 118 of the main body 113. Accordingly, the appropriate first or second load shoulder member 116, 206 may be selected for the packoff 112 depending on whether a stuck tubular is experienced.

Although shown and described as bolted to the packoff 112, the first and/or second load shoulder members 116, 206 may be fixed to the packoff 112 in any suitable manner. To name just a few examples, the first and/or second load shoulder members 116, 206 may be threaded, press fit, or tack welded to the packoff 112. In other embodiments, snap rings or any other connecting structures could be used to connect the first and/or second load shoulder members 116, 206 interchangeably to the packoff 112.

Referring again to FIG. 1, for example, in the case that the first casing hanger 106 has landed on the landing shoulder 104, the first load shoulder member 116 may be selected and connected to the main body 113 of the packoff 112. The packoff 112 may then be deployed around the tubular 108 and into position, such that the first load shoulder member 116 engages the shoulder 110 of the first casing hanger 106.

As shown in FIG. 2, when the tubular 108 is stuck prior to the first casing hanger 106 landing on the shoulder 110, the first casing hanger 106 may be removed and the contingency slip hanger 200 may be positioned against the shoulder 110 and around the tubular 108. If the first load shoulder member 116 is already connected to the packoff 112, it may be disconnected. The second load shoulder member 206 may be connected to the main body 113 of the packoff 112, which may be facilitated by the bolt patterns being the same. The stepped profile of the second load shoulder member 206 may permit the packoff 112 to be lowered into engagement with the bowl 202 of the contingency slip hanger 200, as the axial offset of the shoulder 210 from the lower axial end surface 330 of the annular body 208 may accommodate the slips 204, which may extend upwards from the bowl 202. Thus, in at least some embodiments of the present disclosure, the packoff 112, the first load shoulder member 116, and the second load shoulder member 206 may be provided as a kit, such that the first and second load shoulder members 116, 206 may be available for selection and attachment to the packoff 112 as needed.

The packoff 112, including the body 113 and at least one of the first and second load shoulder members 116, 206 may be provided as a kit. For example, such a kit may include the main body 113 and the first load shoulder member 116, for normal use. If the tubular 108 become stuck, the second load shoulder member 206 may be deployed for use to substitute for the first load shoulder member 116, which maybe removed from the main body 113. In other embodiments, the kit may include both shoulders 116, 206.

With reference to FIGS. 1-5, FIG. 6 illustrates a flowchart of a method 600 for supporting a tubular 108 in a wellhead 102, according to an embodiment. It will be appreciated that at least some of the steps in the method 600 may be conducted in a different order than is presented herein, in parallel, in combination, or separated out into two or more steps.

The method 600 may begin by connecting a first casing hanger 106 to a tubular 108, as at 602. The first casing hanger 106 has a shoulder 110 configured to engage a landing shoulder 104 of a wellhead 102. The first casing hanger 106 may be rigidly connected (e.g., threaded) to an upper end of the tubular 108. The first casing hanger 106 and the tubular 108 may be lowered into the wellhead 102, toward the landing shoulder 104 therein, as at 604. Further, a packoff 112 may be connected to a first load shoulder member 116 and prepared for deployment into the wellhead 102 around the tubular 108, as at 606. In some embodiments, the first load shoulder member 116 may not yet be connected to the packoff 112.

At some point, the tubular 108 may be stuck in the well, preventing the tubular 108 from proceeding further into the well, which may be determined as at 608. If the tubular 108 is stuck, a contingency slip hanger 200 may be deployed to the wellsite for use (or may already be on-hand). In an embodiment, the method 600 may include cutting off the top of the tubular 108, as at 610, which removes the first casing hanger 106 from the remainder of the tubular 108 that is positioned in the wellhead 102. A contingency slip hanger 200 may then be received around the tubular 108 and located on the landing shoulder 104 of the wellhead 102, as at 612.

The method 600 may then proceed to disconnecting the first load shoulder member 116 from the main body 113 of the packoff 112, as at 614 (if it was connected at 606). The second load shoulder member 206 may then be connected to the main body 113 of the packoff 112, as at 616. The packoff 112 with the second load shoulder member 206 may then be received around the tubular 108 and deployed into engagement with the contingency slip hanger 200 in the wellhead 102, as at 618. The stepped profile of the second load shoulder member 206 may permit the second load shoulder member 206 to fit over and around the slips 204 of the contingency slip hanger 200.

Returning to 608, if the tubular 108 is not stuck, and the first casing hanger 106 lands on the landing shoulder 104, the packoff 112 including the first load shoulder member 116 may be deployed into the wellhead 102, as at 620. One or more additional tubulars and casing hangers may be run after either the first casing hanger 106 is landed on the load shoulder 104 or the contingency slip hanger 200 is in place, and the packoff 112 is deployed. Further, in some embodiments, two packoffs 112, one connected to the first load shoulder member 116 and one connected to the second load shoulder member 206 could be selectively employed depending on whether the tubular 108 is stuck.

Figure 7:
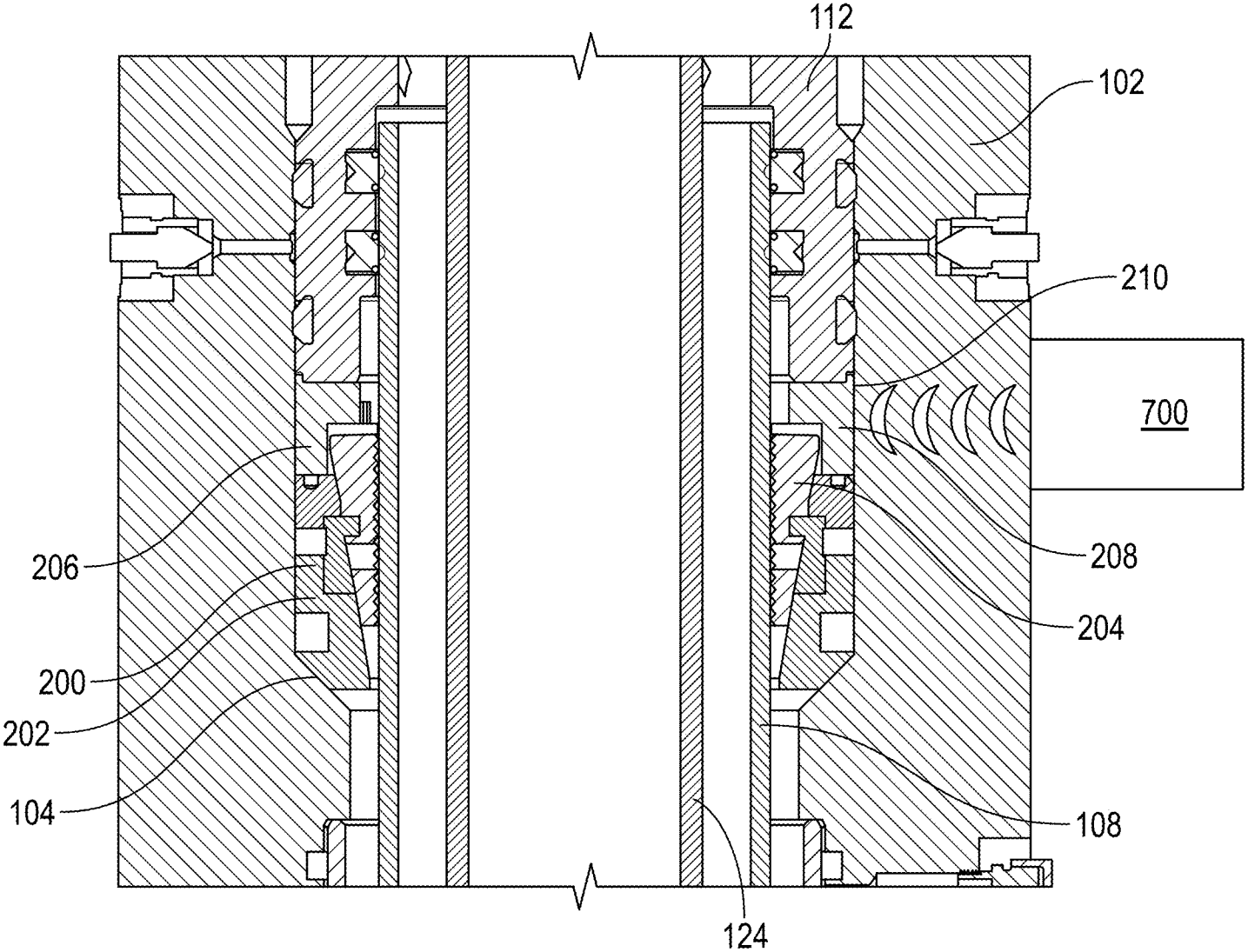
FIG. 7 illustrates a side, partial, cross-sectional view of another embodiment of the wellhead assembly.

FIG. 7 illustrates a side, cross-sectional view of another embodiment of the wellhead assembly 100. This embodiment may be similar to the embodiments discussed above, and may include the packoff 112 configured to be connected to the interchangeable first and second load shoulder members 116 (e.g., FIG. 1) and 206, depending on whether the tubular 108 is fully deployed. In the illustrated embodiment, the tubular 108 was stuck, and the contingency slip hanger 200, including the slips 204 and the bowl 202, was implemented, as discussed above. Accordingly, the second load shoulder member 116, with the annular body 208 and the shoulder 210 was deployed in order to fit over and past the slips 204 and land on the bowl 202 so as to form a seal in the annulus between the tubular 108 and the wellhead 102.

Further, in at least some embodiments, the wellhead assembly 100 may include a sensor 700, which may be coupled to the wellhead assembly 100. In at least some embodiments, the sensor 700 may be coupled directly to an outside of the wellhead 102, but in other embodiments may be positioned within the wellhead 102 or remote therefrom. The sensor 700 may be configured to detect when the second load shoulder member 206, deployed along with the packoff 112, has landed on the bowl 202. For example, the sensor 700 may be placed at the location where the second load shoulder member 206 will be once it lands, and may detect the presence of the second load shoulder member 206 at the position. In other embodiments, the sensor 700 may track the position of the second load shoulder member 206 within the wellhead 102 in other manners. In at least one embodiment, the sensor 700 may be an acoustic sensor. A precise detection of the packoff 112 having reached the position where the second load shoulder member 206 engages the contingency slip hanger 200 may promote proper alignment of locking/sealing structures toward the top of the wellhead 102, which may be located based upon the packoff 112 reaching this position. The sensor 700 may likewise be used to determine a position of the packoff 112 in the case that the casing hanger 110 is used, e.g., when the tubular 108 is not stuck.

Figure 8:
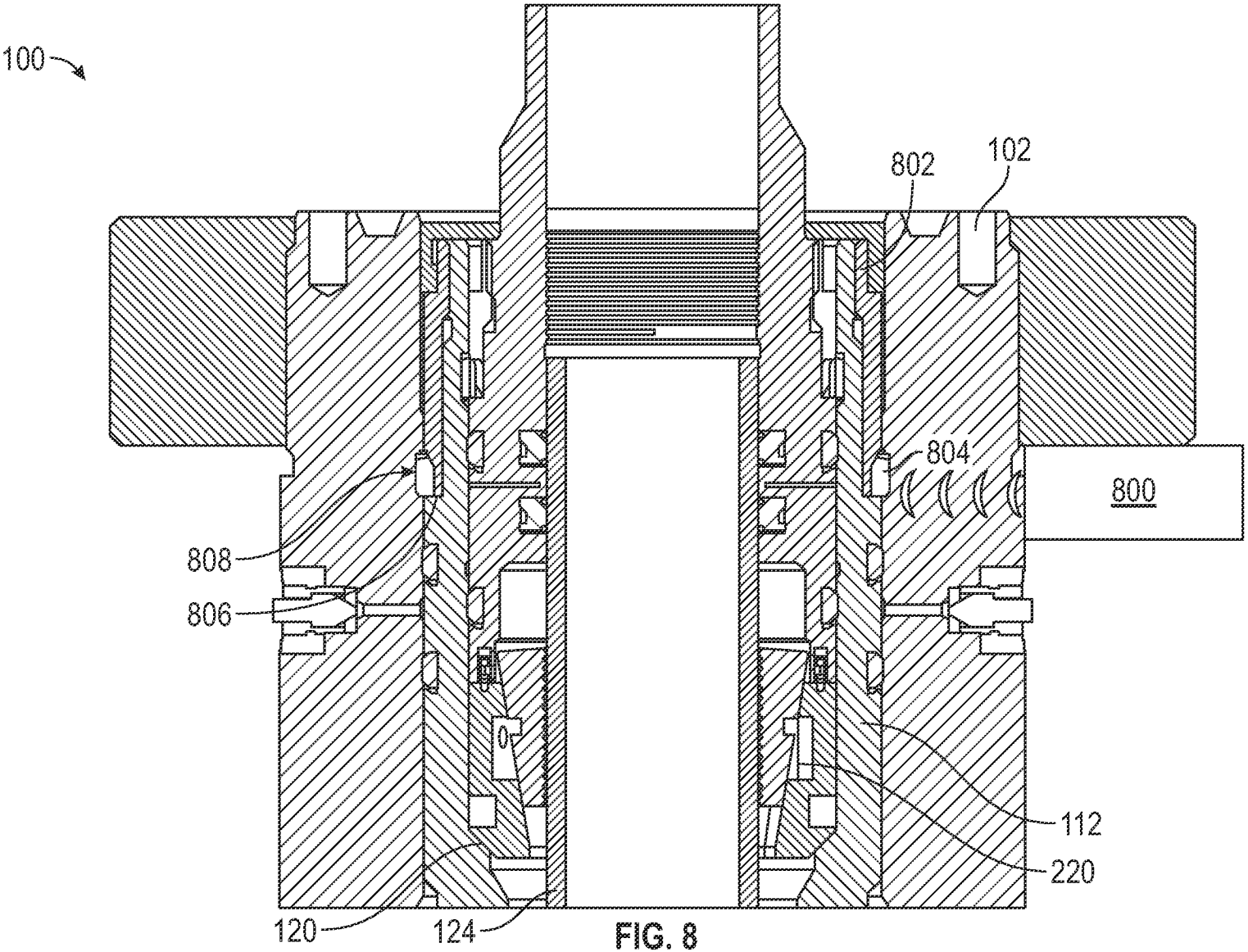
FIG. 8 illustrates a side, partial, cross-sectional view of another embodiment of the wellhead assembly.

FIG. 8 illustrates another embodiment of the wellhead assembly 100. The view of FIG. 8 is higher on the wellhead 102 than the view of FIG. 7, thus the upper contingency slip hanger 220 engaging the inner tubular 124 and landed on the landing shoulder 120 of the packoff 112 is visible, but the contingency slip hanger 200 below the packoff 112 is not visible.

In this embodiment, the wellhead assembly 100 may include a sensor 800, which may, for example, be connected to the wellhead 102. The sensor 800 may be any suitable type of sensor configured to detect a position of a component within the wellhead 102, such as an ultrasonic or another type of acoustic sensor. The sensor 800 may be positioned higher on the wellhead 102 than the sensor 700 of FIG. 7, but may also be configured to detect when the packoff 112 reaches its deployed position, e.g., with the second load shoulder member 206 engaged with the contingency slip hanger 200 (e.g., FIG. 2).

In particular, in this embodiment, the sensor 800 may not directly measure the position of the second load shoulder member 206 (the second load shoulder member 206 may be below this view, e.g., as shown in FIG. 7), but may detect a position of an energizing collar 802 and/or a lock ring 804 positioned around the packoff 112 at a specific location. The energizing collar 802 and/or lock ring 804 may be secured to the packoff 112 and may serve to secure the packoff 112 in the fully deployed position, once that position is reached. For example, the energizing collar 802 and/or the lock ring 804 may slide down along the packoff 112 until reaching a desired location, e.g., proximal to a shoulder 806. When the shoulder 806, where the energizing collar 802 and the lock ring 804 are located, passes a retention groove 808 in the wellhead 102, the lock ring 804 may expand and secure the packoff 112 against upward pressure differentials, and thus the packoff 112 may be in the desired location. Thus, the sensor 800 registering that the lock ring 804 has arrived in the retention groove 808 indicates that the packoff 112 is fully deployed. In some embodiments, both the sensor 700 and the second 800 may be employed, e.g., to provide enhanced confidence as to the location of the packoff 112 in the wellhead 102.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A kit for a packoff for a wellhead, the kit comprising: a body of a packoff configured to be positioned in an annulus between the wellhead and an inner tubular, wherein the body comprises a bore and a lower end, the bore and the lower end being configured to be positioned at least partially around the inner tubular; a first load shoulder member configured to be removably connected to the lower end of the body using bolts and to engage a surface of a casing hanger so as to form a seal therewith; and a second load shoulder member configured to be removably connected to the lower end of the body with the bolts, wherein the second load shoulder member comprises an annular body and a shoulder extending radially-inward therefrom, wherein the shoulder defines first holes, wherein the lower end of the body defines second holes therein for receiving the bolts, wherein the first load shoulder member defines third holes therethrough that align with the second holes to receive the bolts, wherein the first holes align with the second holes to receive the bolts, and wherein the annular body defines fourth holes which receive anti-rotation members.

2. The kit of claim 1, wherein the second load shoulder member is configured to engage the surface of the casing hanger and fit around slips of a contingency casing hanger, and wherein the first load shoulder member is not configured to fit around the slips of the casing hanger.

3. The kit of claim 2, wherein the first and second load shoulder members are interchangeably connectable to the body.

4. The kit of claim 2, wherein the second load shoulder member has a lower axial end surface, wherein the lower axial end surface is configured to engage a bowl of a contingency casing hanger, and wherein the shoulder is configured to fit over slips of the contingency casing hanger.

5. The kit of claim 2, wherein the first load shoulder member defines pockets that communicate with the third holes, the pockets extending radially from an inner diameter surface of the first load shoulder member and axially from a lower axial end surface of the first load shoulder member.

6. The kit of claim 2, wherein the second load shoulder member defines pockets that communicate with the fourth holes and extend radially from an inner diameter surface of the shoulder thereof and axially from a lower axial end surface of the second load shoulder member.

7. The kit of claim 2, further comprising a sensor coupled to the wellhead and configured to detect when the second load shoulder member engages the casing hanger.

8. The kit of claim 1, wherein the body defines a landing shoulder extending into the bore configured to receive and axially support a second casing hanger in the wellhead.

9. The kit of claim 1, wherein the first load shoulder member is configured to be disconnected from the lower end of the body and replaced with the second load shoulder member in response to the casing hanger not reaching a landing shoulder of the wellhead, and wherein the second load shoulder member, when connected to the lower end of the body, is configured to engage a bowl of a contingency slip hanger in the wellhead.

10. The kit of claim 1, wherein the annular body extends farther axially downward than the shoulder, forming a stepped profile for an inner surface diameter of the second load shoulder member.

11. The kit of claim 1, wherein the stepped profile permits the packoff to be lowered into engagement with a bowl of the contingency slip hanger, as an axial offset of the shoulder from a lower axial end surface of the annular body accommodates slips of the contingency hanger, which extend upward from the bowl.

12. A kit for a packoff for a wellhead, the kit comprising: a body of a packoff configured to be positioned in an annulus between the wellhead and an inner tubular, wherein the body comprises a bore and a lower end, the bore and the lower end being configured to be positioned at least partially around the inner tubular, wherein the lower end of the body defines first holes therein for receiving bolts; a first load shoulder member having second holes which align with the first holes to receive the bolts, the first load shoulder member configured to be removably connected to the lower end of the body and to engage a surface of a casing hanger so as to form a seal therewith; and a second load shoulder member configured to be removably connected to the lower end of the body, wherein the second load shoulder member comprises an annular body and a shoulder extending radially-inward therefrom, wherein the annular body extends farther axially downward than the shoulder, forming a stepped profile for an inner surface diameter of the second load shoulder member, wherein the annular body defines third holes that receive anti-rotation features, and wherein the shoulder defines fourth holes that align with the first holes to receive the bolts.

13. The kit of claim 12, wherein the first load shoulder member is configured to be disconnected from the lower end of the body and replaced with the second load shoulder member in response to the casing hanger not reaching a landing shoulder of the wellhead.

* * * * *